US010003870B2

(12) United States Patent
Miao et al.

(10) Patent No.: US 10,003,870 B2
(45) Date of Patent: Jun. 19, 2018

(54) LOUDSPEAKER MODULE EMITTING SOUND AT LATERAL SIDE

(71) Applicant: GOERTEK INC., Weifang, Shandong (CN)

(72) Inventors: Qing Miao, Weifang (CN); Huawei Liu, Weifang (CN); Huaisheng Zhang, Shandong (CN)

(73) Assignee: GOERTEK INC., WeiFeng (CN)

( * ) Notice: Subject to any disclaimer, the term of this patent is extended or adjusted under 35 U.S.C. 154(b) by 0 days. days.

(21) Appl. No.: 15/308,056

(22) PCT Filed: Apr. 1, 2015

(86) PCT No.: PCT/CN2015/075664

§ 371 (c)(1),
(2) Date: Oct. 31, 2016

(87) PCT Pub. No.: WO2015/165319

PCT Pub. Date: Nov. 5, 2015

(65) Prior Publication Data

US 2017/0070796 A1 Mar. 9, 2017

(30) Foreign Application Priority Data

Apr. 30, 2014 (CN) ..... 2014 1 0182250

(51) Int. Cl.
*H04R 1/20* (2006.01)
*H04R 1/02* (2006.01)
(Continued)

(52) U.S. Cl.
CPC ..... *H04R 1/025* (2013.01); *H04R 1/021* (2013.01); *H04R 1/2842* (2013.01); *H04R 1/323* (2013.01);
(Continued)

(58) Field of Classification Search
CPC .. H04M 1/035; H04M 1/6041; H04M 1/0214; H04M 1/0235; H04M 1/0254;
(Continued)

(56) References Cited

U.S. PATENT DOCUMENTS

2001/0009486 A1* 7/2001 Iwahara ..... G11B 25/043 360/99.19
2006/0128430 A1* 6/2006 Shin ..... H04M 1/6041 455/557
(Continued)

FOREIGN PATENT DOCUMENTS

CN 202773040 U 3/2013
CN 103118320 A 5/2013
(Continued)

OTHER PUBLICATIONS

Chinese Office Action, App. No. 201410182250.1, SIPO, Oct. 31, 2016.
(Continued)

*Primary Examiner* — Matthew Eason
*Assistant Examiner* — Julie X Dang
(74) *Attorney, Agent, or Firm* — Holzer Patel Drennan

(57) ABSTRACT

A loudspeaker module emitting sound at a lateral side comprises a loudspeaker unit and a module housing comprising a lower module housing, a middle module housing and an upper module housing. A space formed by the loudspeaker unit, the middle module housing and the lower module housing is a rear sound cavity. A space formed by the loudspeaker unit, the middle module housing and the upper module housing is a front sound cavity. The loudspeaker module further comprises a cover plate which forms a cavity together with the upper module housing. The cavity is communicated with the rear sound cavity through a conducting hole. By utilizing the loudspeaker module of the
(Continued)

present invention, superfluous space of the upper module housing can be converted into the rear sound cavity, and therefore the size of the rear sound cavity is increased, and the acoustic performance of the loudspeaker module is improved.

9 Claims, 7 Drawing Sheets

(51) Int. Cl.
*H04R 1/32* (2006.01)
*H04R 1/28* (2006.01)
*H04R 9/06* (2006.01)

(52) U.S. Cl.
CPC ..... *H04R 1/2888* (2013.01); *H04R 9/06* (2013.01); *H04R 2499/11* (2013.01)

(58) Field of Classification Search
CPC ..... H04M 1/72527; H04R 1/2842; H04R 1/2857; H04R 2499/11; H04R 1/02; H04R 1/021
USPC ..... 381/351
See application file for complete search history.

(56) References Cited

U.S. PATENT DOCUMENTS

2006/0153417 A1* 7/2006 Furuya ..... H04M 1/035 381/396
2006/0273085 A1* 12/2006 Casto ..... B27G 13/002 220/62
2008/0069384 A1* 3/2008 Kim ..... H04M 1/0214 381/189
2013/0170688 A1* 7/2013 Cohen ..... H04R 1/30 381/340
2014/0072162 A1* 3/2014 Huang ..... H04R 1/2807 381/353
2017/0170688 A1* 6/2017 Maniktala ..... H02J 50/12

FOREIGN PATENT DOCUMENTS

CN 103118320 U 5/2013
CN 203301738 U 11/2013
CN 103618984 A 3/2014
CN 103686550 A 3/2014
CN 103686551 A 3/2014
CN 103957487 A 7/2014
CN 203840491 U 9/2014

OTHER PUBLICATIONS

First Office Action, Korean Intellectual Property Office, Nov. 30, 2017.
Notification of the Second Office Action, State Intellectual Property Office of the P.R.C., Jun. 29, 2017.

* cited by examiner

LOUDSPEAKER MODULE EMITTING SOUND AT LATERAL SIDE

CROSS-REFERENCE TO RELATED APPLICATIONS

The present application claims benefit of priority to PCT Application No. PCT/CN2015/075664, entitled "LATERAL SOUND MAKING LOUDSPEAKER MODULE" and filed on 1 Apr. 2015, which is specifically incorporated by reference herein for all that it discloses or teaches. The present application claims further benefit of priority to Chinese Application No. 201410182250.1, which was filed 30 Apr. 2014 and is also specifically incorporated by reference herein for all that it discloses or teaches.

TECHNICAL FIELD

The present invention relates to the technical field of loudspeaker, more specifically, to a loudspeaker module emitting sound at a lateral side.

BACKGROUND ART

As the progress of society and the rapid development of science and technology, portable electronic products, such as, cellphones and ipads, etc., are rising gradually, and become popular due to convenience to carry and comprehensive functionalities, which satisfy people's various requirements, such as, surfing the Internet, communication, and entertainment, etc. As important acoustic components in portable electronic products, loudspeaker modules are widely used thereupon. As the improvement of requirements on portable electronic products, the acoustic performance of the loudspeaker module is being paid more and more attention.

FIG. 1 shows a structural schematic diagram of the existing loudspeaker module emitting sound at a lateral side. As shown in FIG. 1, the existing loudspeaker module emitting sound at the lateral side comprises a loudspeaker unit 1 and a module housing for accommodating and fixing the loudspeaker unit. The module housing comprises a lower module housing 2, a middle module housing 3 and an upper module housing 4. A rear acoustic cavity 7 is defined as a space formed by the loudspeaker unit 1, the middle module housing 3 and the lower module housing 2. A front acoustic cavity 6 is defined as a space formed by the loudspeaker unit 1, the middle module housing 3 and the upper module housing 4. A sound hole is provided on the middle module housing 3 at a position close to the front acoustic cavity 6, and the front acoustic cavity 6 is in communication with the sound hole. As the position of the loudspeaker unit 1 is limited by the position of the sound hole, a space is left above the loudspeaker unit. At present, the space is conventionally processed in such a manner, i.e., after the necessary front acoustic cavity is reserved, the remaining space is processed by locally cutting material to avoid shrinkage of the plastic housing, so that the remaining space cannot be utilized, which causes waste in the acoustic cavity space of the loudspeaker module emitting sound at the lateral side, thereby affecting the acoustic performance of the loudspeaker module emitting sound at the lateral side.

Consequently, there is a need for a technical solution to provide a new loudspeaker module emitting sound at a lateral side, which loudspeaker module is capable of adequately utilizing the space of the acoustic cavity.

SUMMARY

In view of the above problems, an objective of the present invention is to provide a loudspeaker module emitting sound at a lateral side, so as to resolve the problem that the existing loudspeaker module emitting sound at the lateral side is incapable of utilizing the surplus space in the upper module housing.

A loudspeaker module emitting sound at a lateral side provided by the present invention comprises a loudspeaker unit and a module housing for accommodating the loudspeaker unit. The module housing comprises a lower module housing, a middle module housing and an upper module housing. A rear acoustic cavity is defined by the loudspeaker unit, the middle module housing and the lower module housing. A front acoustic cavity is defined by the loudspeaker unit, the middle module housing and the upper module housing, wherein, the loudspeaker module emitting sound at the lateral side further comprises a cover plate which is provided on a top of the upper module housing, and a cavity is defined by the cover plate and the upper module housing; a communicating hole is provided at a position where the upper module housing forming the cavity is connected to the rear acoustic cavity, so that the cavity is in communication with the rear acoustic cavity through the communicating hole; the front acoustic cavity is separated from the rear acoustic cavity by sealing the communicating hole.

With the above loudspeaker module emitting sound at the lateral side provided by the present invention, by adding the cover plate at the top of the upper module housing, a cavity is formed by the upper module housing, and the cavity is in communication with the rear acoustic cavity, so as to increase the volume of the rear acoustic cavity, improve the acoustic performance of the loudspeaker module emitting sound at the lateral side, and avoid undesirable influence on the appearance of the loudspeaker module due to locally cutting material, and provide filter function to the sound generated by the loudspeaker module to a certain degree, thereby smoothing tone quality curves and making the sound more sweet-sounding.

In order to achieve the above and related objectives, one or more aspects of the present invention comprise the features detailed below and indicated particularly in the claims. Some exemplary aspects of the present invention are described in details by the description below and the accompanying drawings. However, these aspects only indicate some implementations of various implementations of the present invention. In addition, the present invention is intended to contain these aspects and the equivalents thereof.

BRIEF DESCRIPTION OF THE DRAWINGS

By referring to the descriptions in connection with the accompanying drawings and the contents of the claims, and with a full understanding of the present invention, other purposes and results of the present invention will be more clearly and easily understand. In the drawings:

Same reference numerals in all of the accompanying drawings indicate similar or corresponding features or functions.

Figure 1:
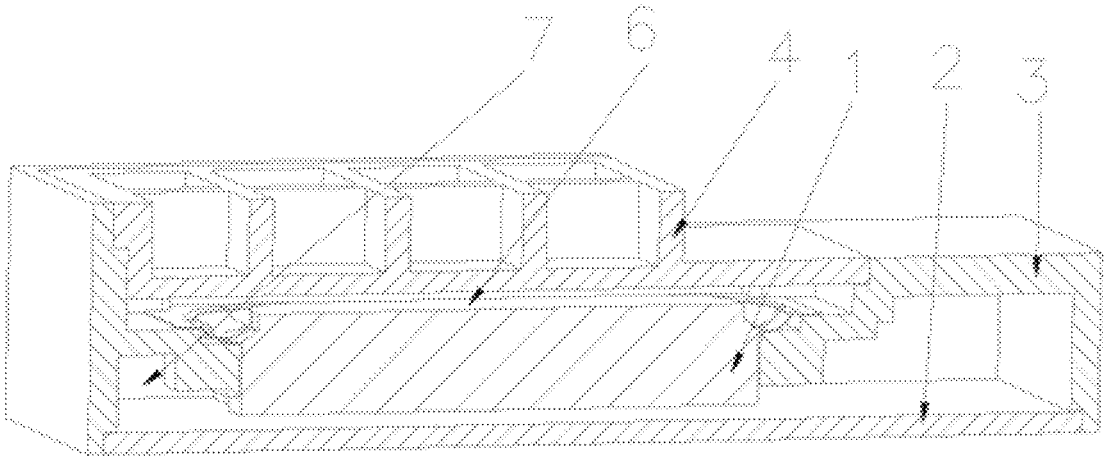
FIG. 1 is a structural schematic diagram of the existing loudspeaker module emitting sound at the lateral side.

Wherein, the reference numerals comprises: loudspeaker unit 1, lower module housing 2, middle module housing 3, upper module housing 4, sound hole 5, front acoustic cavity 6, rear acoustic cavity 7, cover plate 8, diaphragm 9, communicating hole 10, cavity 11, slot 12-14, fixing rib 15.

DETAILED DESCRIPTION OF EMBODIMENTS

Various specific details are set forth in the following description to comprehensively understand one or more embodiments for sake of illustration. However, it is obvious that these embodiments can be implemented without such specific details. In other examples, known structures and devices are illustrated by block diagrams to facilitate describing one or more embodiments.

Hereinafter, particular embodiments of the present invention are described in connection with the accompanying drawings.

As for the problem that the existing loudspeaker module emitting sound at the lateral side is incapable of utilizing the redundant space in the upper module housing, in the present invention, the redundant space in the upper module housing is transformed into a rear acoustic cavity, thereby increasing the volume of the rear acoustic cavity. Two particular embodiments are taken as examples to explain how to increase the volume of the rear acoustic cavity by utilizing the redundant space in the upper module housing.

Embodiment 1

Figure 2:
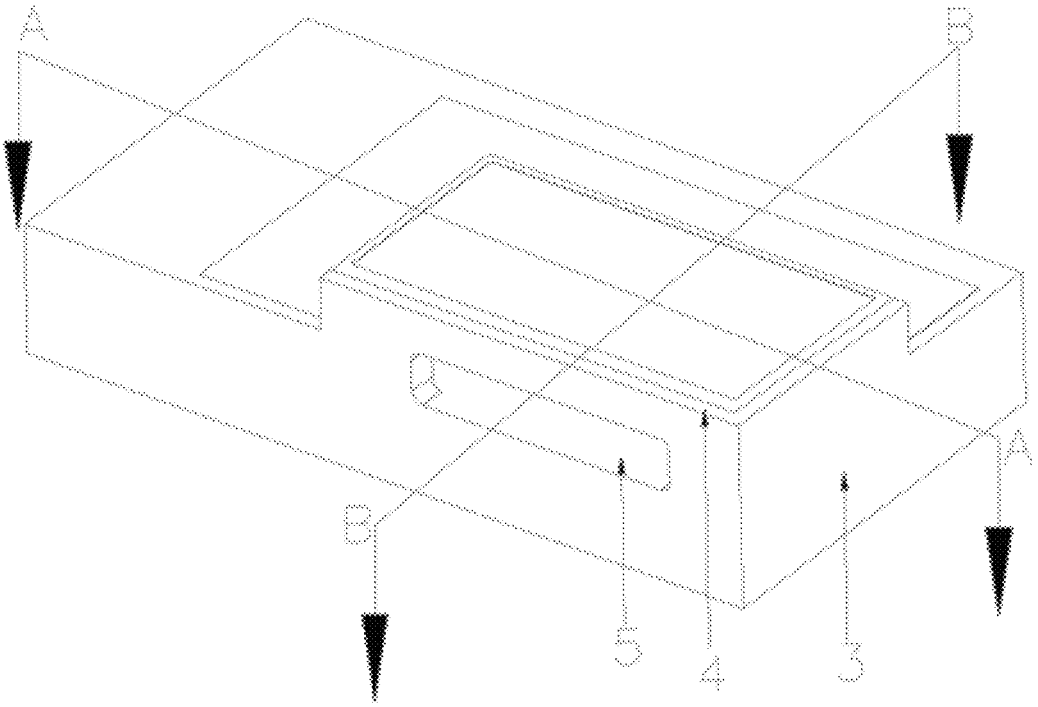
FIG. 2 is a structural schematic diagram of the loudspeaker module emitting sound at the lateral side according to the embodiment 1 of the present invention.
Figure 3:
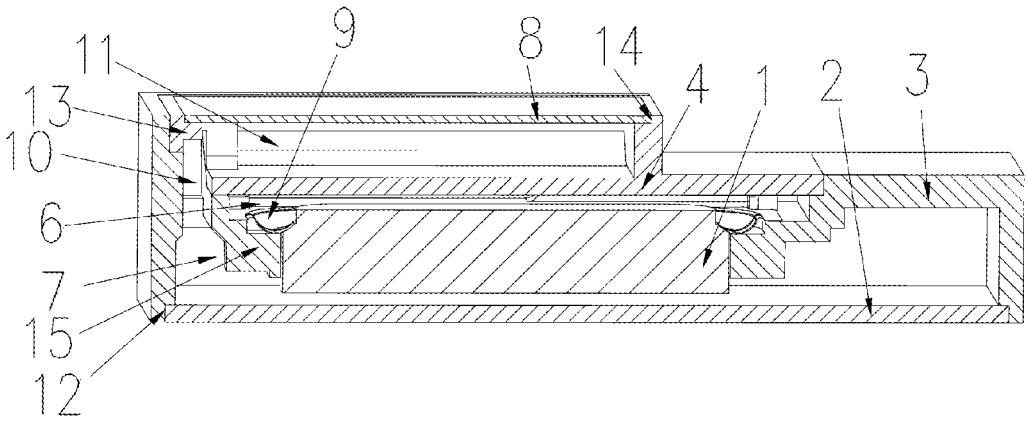
FIG. 3 is a section view taken along line A-A in FIG. 2.
Figure 4:
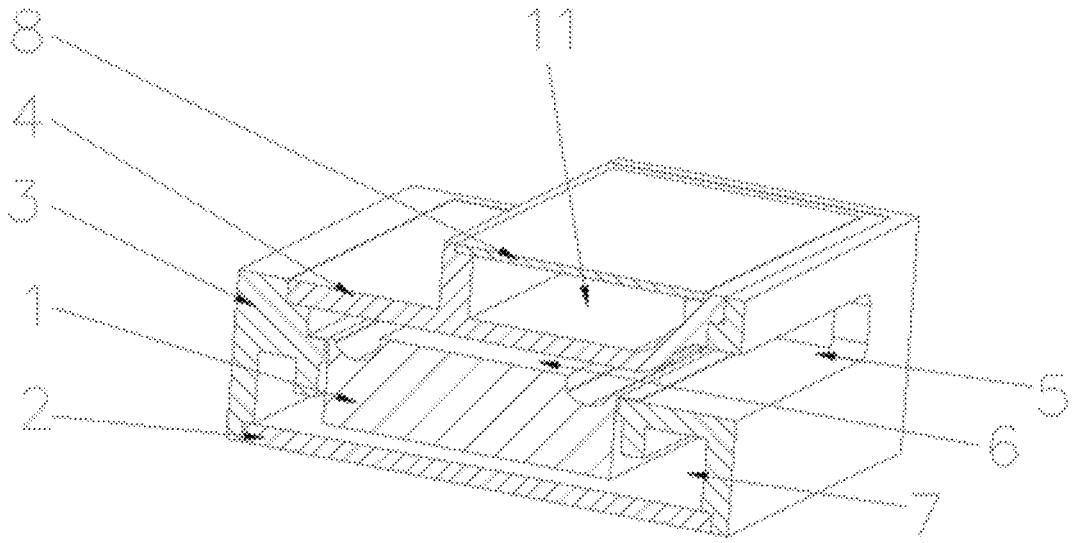
FIG. 4 is a section view taken along line B-B in FIG. 2.

FIG. 2, FIG. 3 and FIG. 4 are a structural schematic diagram of the loudspeaker module emitting sound at the lateral side according to the embodiment 1 of the present invention, a section view taken along line A-A in FIG. 2 and a section view taken along line B-B in FIG. 2, respectively.

As shown in FIG. 2, FIG. 3 and FIG. 4, a loudspeaker module emitting sound at a lateral side is provided in the embodiment 1 of the present invention, the loudspeaker module emitting sound at the lateral side comprises a loudspeaker unit 1 and a module housing for accommodating the loudspeaker unit 1. The loudspeaker unit comprises a diaphragm 9. The module housing comprises a lower module housing 2, a middle module housing 3 and an upper module housing 4 which are successively combined.

After the front acoustic cavity is achieved by the upper module housing 4, in order to utilize the redundant space in the upper module housing 4, a cover plate 8 is provided on the top of the upper module housing 4 to be fitted to the slots 14 in four sidewalls of the upper module housing 4, so as to form a cavity 11 with the upper module housing 4.

It should be noted that the cover plate 8 may be a sheet with certain strength. As a particular implementation of the embodiment 1 of the present invention, a metal sheet or alloy sheet with certain strength is used as the cover plate 8, such as, a steel sheet, an iron sheet, a copper sheet or the like, so as to reduce the thickness of the cover plate 8 while guaranteeing strength. Likewise, PET or other resin materials may be used.

In order to firmly fit the lower module housing 2 to the bottom of the middle module housing 3, a concave slot 12 formed by removing materials is provided on the bottom of the sidewall of the middle module housing 3, and the lower module housing 2 is fitted to the bottom of the middle module housing 3 through the slot 12. A concave slot 13 formed by removing materials is provided on the top of the sidewall of the middle module housing 3, and the upper module housing 4 is fitted to the top of the middle module housing 3 through the slot 13.

A stepped fixing rib 15 protruding from the inner wall of the middle module housing 3 is provided at the middle position of the middle module housing 3, the loudspeaker unit 1 is fitted to the middle module housing 3 through the fixing rib 15, and the fixing rib 15 is integrally formed with the middle module housing 3.

Wherein, a rear acoustic cavity 7 is formed by the space below the diaphragm 9 which space is formed by the loudspeaker unit 1, the lower module housing 2, and the middle module housing 3; a front acoustic cavity 6 is formed by the space above the diaphragm 9 which space is formed between the loudspeaker unit 1 and the bottom edge of the upper module housing 4; and the front acoustic cavity and the rear acoustic cavity are separated by the fixing rib 15. The cavity 11 and the rear acoustic cavity 7 are separated by the bottom wall of the upper module housing 4. In order to communicate the cavity 11 and the rear acoustic cavity 7, a communicating hole 10 is provided on the bottom wall of the upper module housing 4 at a position where the rear acoustic cavity 7 is connected to the cavity 11, so as to communicate the cavity 11 and the rear acoustic cavity 7, and thus the cavity 11 is used as the rear acoustic cavity, thereby enlarging the volume of the rear acoustic cavity.

It should be noted that, as most of components of the loudspeaker module are formed by plastic materials, it is very difficult to conduct secondary operation after assembly of the module housing, and the space limit on the loudspeaker module makes the secondary operation difficult after assembly of the module housing. Thus, the provided communicating hole 10 is not provided after assembly of the upper module housing 4 and the middle module housing 3, but holes are provided at respective predetermined positions on the middle module housing 3 and the upper module housing 4 in advance, and then the holes on the middle module housing 3 and the upper module housing 4 are correspondingly bonded and sealed to form the communicating hole 10 while assembling the middle module housing 3 and the upper module housing 4.

As the rear acoustic cavity of the loudspeaker module is required to be sealed, the portion where the front acoustic cavity contacts with the rear acoustic cavity of the loudspeaker module is required to be sealed completely, wherein, the position where the above upper module housing 4 is fitted to the middle module housing 3, the position where the middle module housing 3 is fitted to the lower module housing 2, and the position where the loudspeaker unit 1 is fitted to the middle module housing 3 may be sealed by ultrasonic welding or gumming or compression joint or the like. Meanwhile, the position where the cover plate 8 is fitted to the upper module housing 4 is required to be sealed, and thus the position where the cover plate 8 is fitted to the upper module housing 4 may be likewise sealed by ultrasonic welding or gumming or compression joint or the like. Likewise, the cavity 11 and the front acoustic cavity are mutually isolated.

A sound hole 5 is provided on the middle module housing 3 at a position adjacent to the front acoustic cavity 6, and the front acoustic cavity 6 is in communication with the sound hole 5, so as to export sound signals generated by the loudspeaker module.

The structure of the loudspeaker module emitting sound at the lateral side in the embodiment 1 of the present invention is described above. As can be seen, in the embodiment 1 of the present invention, by providing a cover plate on the upper module housing, the cover plate forms a cavity with the upper module housing, and then the cavity is in communication with the rear acoustic cavity to transform the redundant space in the upper module housing into the rear acoustic cavity, thereby maximizing the volume of the rear acoustic cavity. Because the larger the volume of the rear acoustic cavity, the better the bass effect, the loudspeaker module emitting sound at the lateral side provided by the embodiment of the present invention can achieve good acoustic performance.

Embodiment 2

Figure 5:
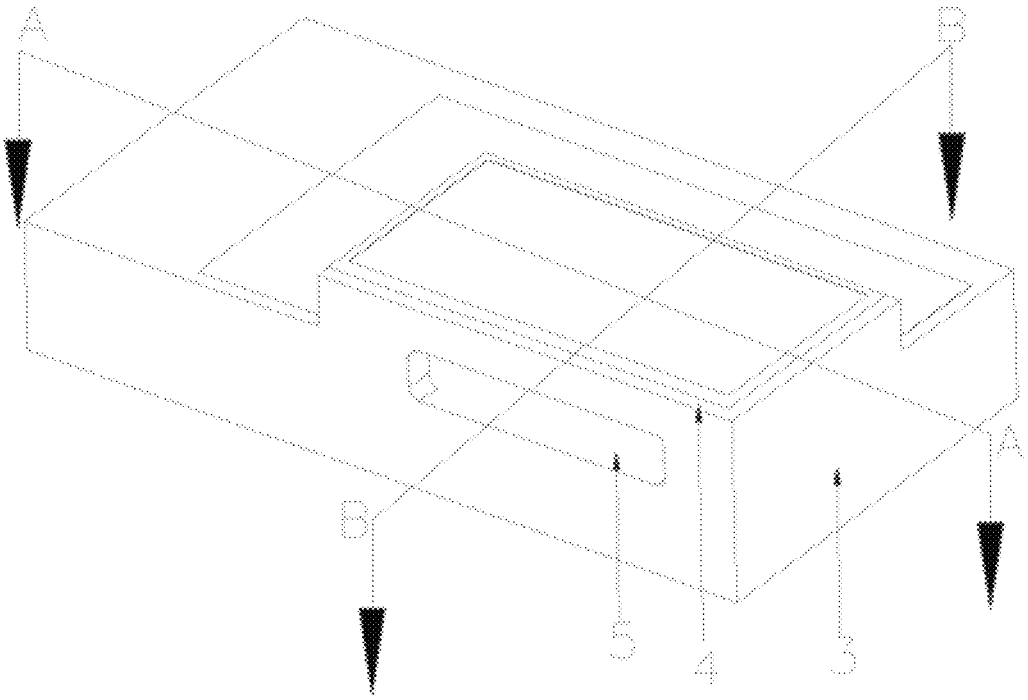
FIG. 5 is a structural schematic diagram of the loudspeaker module emitting sound at the lateral side according to the embodiment 2 of the present invention.
Figure 6:
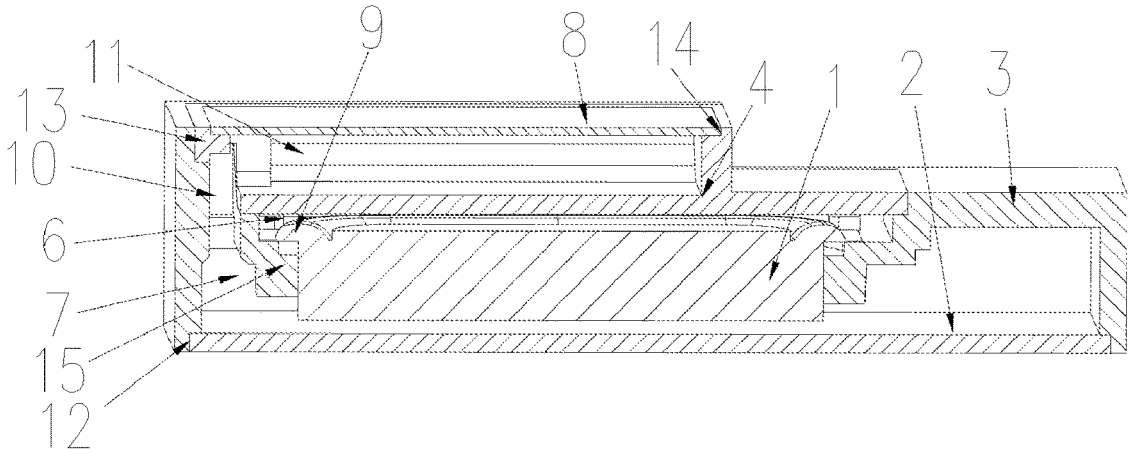
FIG. 6 is a section view taken along line A-A in FIG. 5.
Figure 7:
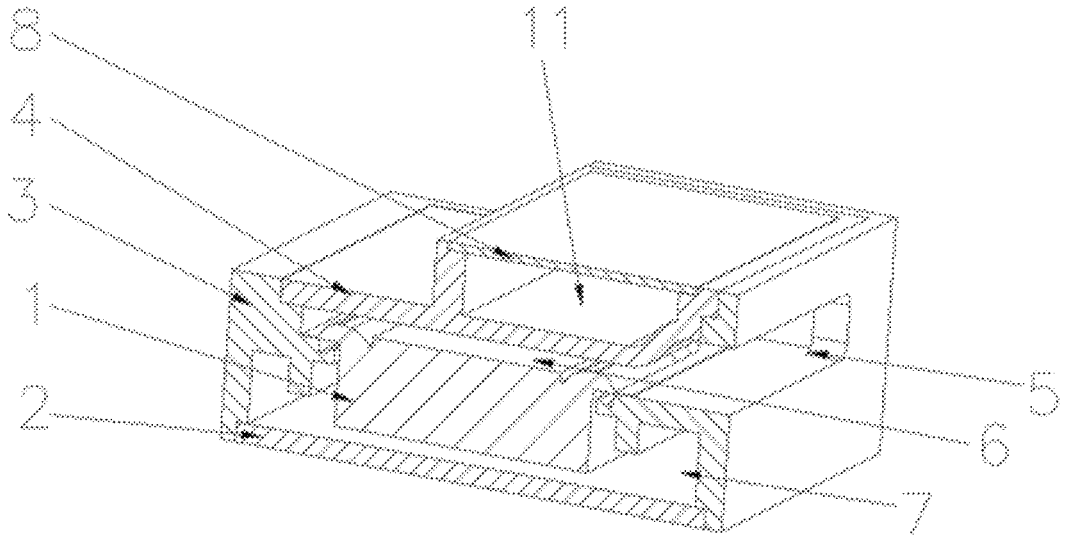
FIG. 7 is a section view taken along line B-B in FIG. 5.

FIG. 5, FIG. 6 and FIG. 7 are a structural schematic diagram of the loudspeaker module emitting sound at the lateral side according to the embodiment 2 of the present invention, a section view taken along line A-A in FIG. 5, and a section view taken along line B-B in FIG. 5, respectively.

As shown in FIG. 5, FIG. 6 and FIG. 7, a loudspeaker module emitting sound at a lateral side is provided in the embodiment 2 of the present invention, similarly, the loudspeaker module emitting sound at the lateral side comprises a loudspeaker unit 1 and a module housing for accommodating the loudspeaker unit. The loudspeaker unit comprises a diaphragm 9 provided upward. The module housing comprises a lower module housing 2, a middle module housing 3 and an upper module housing 4. The upper module housing 4 has a cavity with an open top formed by four sidewalls and a bottom wall, and concave slots 14 formed by removing materials are provided on the four sidewalls of the upper module housing 4, said slots 14 are used for firmly fitting the cover plate 8 to the top of the upper module housing 4 so as to form a cavity 11. The cover plate 8 may be fitted to the top of the upper module housing 4 by a sealing method, such as, ultrasonic welding or gumming or compression joint or the like, so as to seal the top of the cavity 11.

In a particular implementation of the embodiment 2 of the present invention, the cover plate 8 may be a sheet with certain strength, and a sheet with certain strength, such as, a metal sheet or alloy sheet with certain strength is used as the cover plate 8, such as, a steel sheet, an iron sheet, a copper sheet or the like, so as to reduce the thickness of the cover plate 8 while guaranteeing strength. In addition to this, the cover plate 8 may be formed by PET or other resin materials.

Likewise, in order to firmly fit the lower module housing 2 to the bottom of the middle module housing 3, a concave slot 12 formed by removing materials is provided on the bottom of the sidewall of the middle module housing 3, and the lower module housing 2 is fitted to the bottom of the middle module housing 3 through the slot 12. A concave slot 13 formed by removing materials is provided on the top of the sidewall of the middle module housing 3, and the upper module housing 4 is fitted to the top of the middle module housing 3 through the slot 13. The above upper module housing 4 may be fitted to the top of the middle module housing 3 by a sealing method, such as, ultrasonic welding or gumming or compression joint or the like, and the lower module housing 2 may also be fitted to the bottom of the middle module housing 3 by a sealing method, such as, ultrasonic welding or gumming or compression joint or the like.

A stepped fixing rib 15 protruding from the inner wall of the middle module housing 3 is provided at the middle position of the middle module housing 3, so as to fix the loudspeaker unit 1 on the middle module housing 3. The fixing rib 15 is integrally formed with the middle module housing 3.

Wherein, a rear acoustic cavity 7 is formed by the space between the loudspeaker unit 1, the lower module housing 2, the middle module housing 3 and the fixing rib 15; a front acoustic cavity 6 is formed by the space between the loudspeaker unit 1, the fixing rib 15 and the bottom edge of the upper module housing 4; and the front acoustic cavity 6 and the rear acoustic cavity 7 are separated by the fixing rib 15. Meanwhile, the top of the fixing rib in the vertical direction is connected to the bottom edge of the upper module housing 4, and the cavity 11 and the rear acoustic cavity 7 are separated by the bottom edge of the upper module housing 4. In order to communicate the cavity 11 and the rear acoustic cavity 7, a communicating hole 10 is provided on the bottom of the upper module housing 4 at a position where the rear acoustic cavity 7 is connected to the cavity 11, so as to communicate the cavity 11 and the rear acoustic cavity 7 to form a large rear acoustic cavity.

As the loudspeaker unit 1 and the lower module housing 2 are fitted to the middle module housing 3 in a sealing manner, and the top of the cavity 11 is sealed, the large rear acoustic cavity formed by communicating the cavity 11 and the rear acoustic cavity 7 is sealed. Thus, the sealed large rear acoustic cavity and the front acoustic cavity 6 are separated.

A sound hole 5 is provided on the middle module housing 3 at a position close to the front acoustic cavity 6, and the front acoustic cavity 6 is in communication with the sound hole 5, so as to output sound signals generated by the loudspeaker module.

The loudspeaker module emitting sound at the lateral side provided by the present invention is described in the above embodiments 1 and 2 in details. By adding a cover plate at the top of the upper module housing, the upper module housing forms a cavity, and then the cavity is in communication with the rear acoustic cavity to increase the volume of the rear acoustic cavity, improve the acoustic performance of the loudspeaker module emitting sound at the lateral side, and avoid undesirable influence on the appearance of the loudspeaker module due to locally cutting materials, and provide filter function to the sound generated by the loudspeaker module to a certain degree, thereby smoothing tone quality curves and making the sound more sweet-sounding.

As described above, the loudspeaker module emitting sound at the lateral side provided by the present invention is described by way of example with reference to the accompanying drawings. However, it should be understood by those skilled in the art that various improvements on details achieved therein can be made to the loudspeaker module emitting sound at the lateral side provided by the present invention as described above, without depart from the contents of the present invention. Accordingly, the scope of protection of the present invention is determined by the contents of the appended claims.

What is claimed is:

1. A loudspeaker module to emit sound at a lateral side, comprising:

a loudspeaker unit and a module housing for accommodating and fixing the loudspeaker unit, wherein the module housing comprises a lower module housing, a middle module housing and an upper module housing;

a rear acoustic cavity defined by the loudspeaker unit, the middle module housing and the lower module housing;

a front acoustic cavity defined by the loudspeaker unit, the middle module housing and the upper module housing;

a sound hole provided on the middle module housing adjacent to and in communication with the front acoustic cavity, wherein each of the middle module housing and the upper module housing have a base surface above the loudspeaker unit and an annular wall portion extending upward from the base surface adjacent the sound hole;

a cover plate provided on a top of the upper module housing;

an independent cavity defined by the cover plate and the upper module housing; and a communicating hole provided at a position where a bottom of the upper module housing forming the independent cavity is connected to the rear acoustic cavity, so that the independent cavity is in communication with the rear acoustic cavity through the communicating hole.

2. The loudspeaker module to emit sound at the lateral side according to claim 1, further comprising:

slots on a bottom and a top of the middle module housing, the lower module housing fitted to one of the slots on the bottom of the middle module housing, and the upper module housing fitted to one of the slots on the top of the middle module housing.

3. The loudspeaker module to emit sound at the lateral side according to claim 2, wherein the slots are concave slots formed by removing materials.

4. The loudspeaker module to emit sound at the lateral side according to claim 2, further comprising:

a fixing rib for fixing the loudspeaker unit at a middle position of the middle module housing.

5. The loudspeaker module to emit sound at the lateral side according to claim 4, wherein the loudspeaker unit comprises a diaphragm provided upward, and the diaphragm is coupled to the fixing rib.

6. The loudspeaker module to emit sound at the lateral side according to claim 4, wherein the loudspeaker unit comprises a diaphragm provided downward, and the diaphragm is coupled to the fixing rib.

7. The loudspeaker module to emit sound at the lateral side according to claim 4, wherein the fixing rib is a stepped fixing rib.

8. The loudspeaker module to emit sound at the lateral side according to claim 1, wherein a position where the upper module housing is fitted to the middle module housing, a position where the middle module housing is fitted to the lower module housing, and a position where the loudspeaker unit is fitted to the middle module housing are each sealed by one of ultrasonic welding, gumming, and forming a compression joint.

9. The loudspeaker module to emit sound at the lateral side according to claim 1, wherein the cover plate is formed by one of steel sheet and PET.

* * * * *